US005934260A

United States Patent [19]

Gadkaree et al.

[11] Patent Number: 5,934,260

[45] Date of Patent: Aug. 10, 1999

[54] FUEL VAPORIZATION SYSTEM FOR STARTING AN INTERNAL COMBUSTION ENGINE

[75] Inventors: Kishor P. Gadkaree, Big Flats, N.Y.; Hamid B. Servati, Farmington Hills, Mich.; Paul M. Then, Glashutten, Germany

[73] Assignee: Corning Incorporated, Corning, N.Y.

[21] Appl. No.: 08/943,917

[22] Filed: Oct. 3, 1997

Related U.S. Application Data

[60] Provisional application No. 60/027,900, Oct. 7, 1996.

[51] Int. Cl.[6] ..... F02M 37/04

[52] U.S. Cl. ..... 123/520; 123/179.17

[58] Field of Search ..... 123/179.17, 520, 123/518, 519, 516, 521, 198 D

[56] References Cited

U.S. PATENT DOCUMENTS 5,474,047 12/1995 Cochard ..... 123/520

5,474,049 12/1995 Nagaishi ..... 123/520

5,638,795 6/1997 Hara ..... 123/520

*Primary Examiner*—Carl S. Miller

*Attorney, Agent, or Firm*—Timothy M. Schaeberle

[57] ABSTRACT

Disclosed is cold-start fuel vapor emission control system for an internal combustion engine having an intake manifold and a fuel tank, comprising the following components: (1) a housing for containing an honeycomb adsorber for adsorbing fuel vapor; (2) a vapor passage for fluidly connecting the housing and the fuel tank; (3) a charging system for measuring the quantity of adsorbed fuel vapor and for, if necessary, increasing the amount of adsorbed fuel vapor to a level sufficient to "vapor-only" start the engine; (4) a purging passage connecting the housing to an intake manifold for introducing a mixture comprised of the fuel vapor and air to the intake manifold. In a preferred embodiment, the honeycomb adsorber comprises a monolithic, binderless honeycomb structure having a continuous activated carbon phase.

23 Claims, 5 Drawing Sheets

FUEL VAPORIZATION SYSTEM FOR STARTING AN INTERNAL COMBUSTION ENGINE

This application claims the benefit of U.S. Provisional Application No. 60/027,900, filed Oct. 17, 1996, entitled Fuel Vaporization System for Starting an Internal Combustion Engine, by Kishor P. Gadkaree, Hamid B. Servati, and Paul M. Then.

BACKGROUND OF THE INVENTION

1. Field of the Invention

The present invention generally relates to an apparatus and method for adsorbing fuel vapor and thereafter desorbing and supplying a sufficient amount of the vaporized fuel necessary to start an internal combustion engine using only the fuel vapor.

2. Description of the Related Art

Although catalytic converters are well known for reducing oxides of nitrogen (NOx), and oxidizing hydrocarbons and carbon monoxide from automobile exhaust, these reactions typically take place after the catalyst has attained its light-off temperature, at which point the catalyst begins to convert the hydrocarbons to harmless gases. The typical catalytic light-off time for most internal combustion engine systems is around 50 to 120 seconds (generally in the temperature range of 200–350° C.), although the actual catalytic light-off time for any system depends on various factors; including, for instance, the aging of the catalyst. Seventy to almost ninety five percent of hydrocarbon emissions from automotive vehicles are emitted during this first minute, or so, of "cold start" engine operation. As the standards relating to emission control of automobiles become more stringent, increasing the effectiveness of automotive emission control systems by reducing the amount of hydrocarbons discharged into the atmosphere during cold-start has become increasingly important.

Cold-start engine systems utilizing fuel vapor-purging methods for internal engines are widely known and have been investigated as system solutions for reducing cold-start emissions. Generally, these systems include a canister having activated charcoal or other hydrocarbon adsorbing material for adsorbing fuel vapor generated from the fuel tank in the form of packed pellet bed, a purging passage connecting between the canister and the intake passage for purging a mixture of the fuel vapor and air therethrough into the intake passage. When starting the engine in a cold-start condition these systems generally operate to supply the engine with both fuel injected from the fuel injection valves as well as fuel vapor purged from the canister. Representative systems include, Japanese Provisional Utility Model Publication (Kokai) No. 3-97560, U.S. Pat. Nos. 5,224,456 (Hosoda et al) 5,349,934 (Miyano), and 5,482,023 (Hunt et al.). While these systems have improved exhaust emission characteristics, they still involve injecting a portion of liquid fuel into the intake chamber without the fuel being vaporized, which during cold-start conditions results in some part of this liquid fuel attaching to the intake walls and thereafter being emitted as unburnt hydrocarbons.

An improvement over the above standard cold-start systems is disclosed in U.S. Pat No. 5,474,047 (Cochard et al.) wherein it describes a process for supplying fuel to an internal combustion engine with controlled fuel injection and comprising a controlled fuel vapor recovery system. During cold-start operating phases of the engine, the fuel injectors remain inoperative for a given period while the fuel vapors trapped in the recovery system are recycled into the intake circuit of the engine. Although this reference discloses a "vapor-only" process cold-start engine system, this system suffers from a number of disadvantages. (1) electrically heating the adsorber filter from the outside is likely to result in slower than industry desired vapor desorption, i.e., a system in which starting of the engine is delayed; (2) absence of a mechanism in the system to guarantee that there is sufficient vapor available to start the engine; and, (3) this system having a activated carbon packed bed pellet configuration is likely to generate insufficient vapor as a result the inherent high pressure drop associated with packed bed configurations.

Notwithstanding the foregoing developments, work has continued to discover and provide new engine systems not only capable of meeting the stricter governmental emission standards but which are also capable of consistently and quickly "vapor-only" starting.

SUMMARY OF THE INVENTION

Accordingly, described herein is a cold-start fuel vapor emission control system for an internal combustion engine having an intake manifold and a fuel tank, comprising the following components: (1) a housing, having both a vapor and an air inlet end, for containing an honeycomb adsorber for adsorbing fuel vapor; (2) a vapor passage for fluidly connecting the housing and the fuel tank; (3) a charging stem which measures the quantity of adsorbed fuel vapor and which, if necessary, increases the amount of adsorbed vapor to a level sufficient to "vapor-only" start the engine; (4) a purging passage connecting the housing to an intake manifold for introducing a mixture comprised of desorbed vaporized fuel and air to the intake manifold.

DETAILED DESCRIPTION OF THE INVENTION

Figure 1:
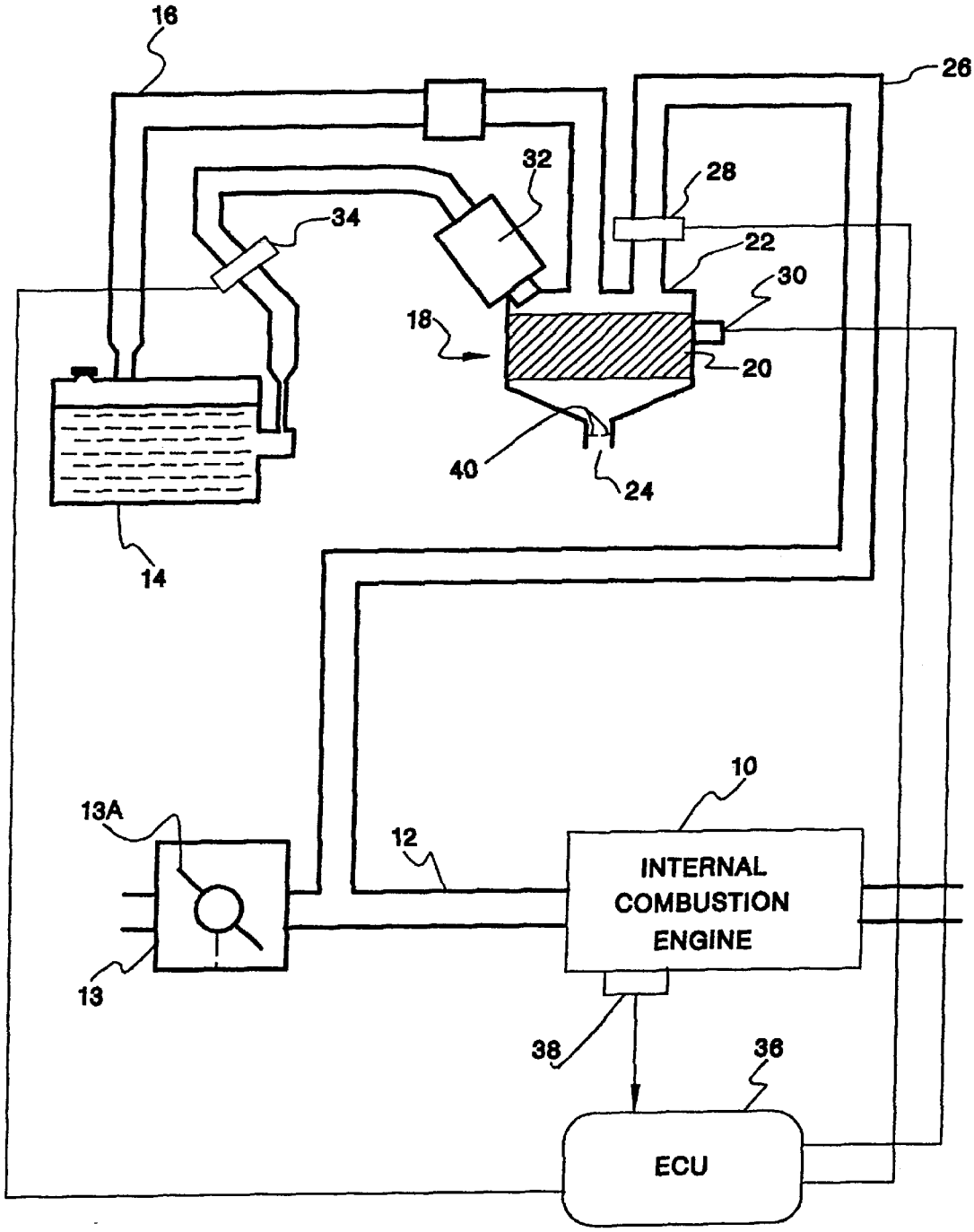
FIG. 1 is a block diagram schematically illustrating the arrangement of an fuel vapor emission control system for an internal combustion engine, according to an embodiment of the invention.

Referring now to FIG. 1, illustrated therein is the arrangement of a fuel vapor emission control system capable of starting an internal combustion engine, according to an embodiment of the invention. In the figure, reference numeral 10 designates an internal combustion engine having an intake manifold 12 and a fuel tank 14. Fluidly connected to the fuel tank 14, via a vapor passage 16, is a housing 18 for containing an honeycomb adsorber 20 for adsorbing fuel vapor. The housing includes a vapor inlet 22 and an air inlet 24 open to ambient air. The system further includes a purging passage 26 connecting housing 18 to intake manifold 12 possessing a normally closed purge valve 28. When open, purge valve 28 allows for a mixture comprised of desorbed fuel vapor and air to be introduced into intake manifold 12 upstream of a throttle body 13 and accompanying throttle valve 13A.

The emission system further includes a charging system which functions during cold engine conditions to measure the quantity of adsorbed fuel vapor and, if necessary, increase the amount of adsorbed fuel to a level sufficient to "vapor-only" start the engine. In the construction illustrated in FIG. 1, the charging system includes a means 30 for measuring the quantity of fuel vapor adsorbed and for providing an output signal representative. It further features a fuel injector 32 connected to a pump 34 for delivering liquid fuel to the surface of honeycomb adsorber 20 whenever the adsorbed fuel output signal is less than a predetermined amount necessary to "vapor-only" start the engine.

The means for measuring the quantity of adsorbed vaporized fuel may comprise, in the conventional sense, a vapor sensor comprised of a pair of electrodes separated by a quantity of the adsorbent in the housing through which the air and vapor mixture passes through during engine operation. The vapor sensor operates as a capacitance variable as a function of the quantity of vapor adsorbed on the adsorbent between the electrodes. With the passage of the air and vapor mixture therethrough the quantity of vapor adsorbed between the electrodes increases.

Another means for determining the amount of vaporized fuel may comprise a system which tracks the number and times of the purge and start cycles of the system. These cycles, along with parameters such as the ambient conditions, the number of times in which the tank is filled, the size of the engine and the fuel vaporization system, would be tracked and monitored to determine the amount of trapped vaporized fuel.

An electronic control unit (ECU) 36 controls the operation of the starting fuel supply control system and the charging system of the present invention. Typically, the ECU 36 is microprocessor based and receives a plurality of input signals from various engine sensors. These input signals include signals from vapor sensor 30, engine temperature sensor 38, as well as other conventional engine sensors.

In a preferred embodiment, the air inlet is sized so that the appropriate amount of vapor passes through the adsorber whereby the air/fuel mixture delivered to the engine exhibits approximately a stoichiometric ratio. In certain configurations, rather than reducing the size of the air inlet it may be desirable to restrict the size of the air inlet by including air inlet orifice 40 which is smaller than the diameter of air inlet 24, as well as purging passage 26. As a direct result of the reduction of air flow and the maintaining of the vacuum condition, standard in the purge passage under normal engine operation, the stoichiometric fuel-air ratio, and thus engine operation is maintained for a longer period of time.

It is contemplated that the air inlet be provided with orifice capable exhibiting a variable size, for instance, throttle plate. The advantage of this variably sized orifice is that it allows for a system whereby the amount of air, and the thereby the air/fuel ratio, could be regulated and maintained at nearly stoichiometric, in spite of changing ambient and engine conditions.

The operation of the starting fuel supply control system essentially functions in a standard way as follows. During engine operation fuel vapor from fuel tank 14 flows into vapor passage 16 and thereafter into housing 18 whereupon it is adsorbed by the honeycomb adsorber 20. Fuel vapor purge occurs when vapor sensor 30 exceeds a predetermined value whereupon ECU 36 generates an output signal which operates to open normally closed purge valve 28. During this vapor purge, air is drawn through air inlet 24 and thereafter passes through the honeycomb adsorber desorbing and mixing with the earlier trapped fuel vapor.

Activated carbon honeycomb adsorbers are especially useful in the practice of this invention, preferably in the form of a monolithic, binderless honeycomb structure having a continuous activated carbon phase.

In one embodiment, the honeycomb adsorber comprises an inorganic monolithic substrate, preferably cordierite, with pores extending into the substrates surface. The substrate further includes a substantially continuous adherent coating comprising a layer of activated carbon extending over the substrate's surface and which penetrates into the pores. U.S. Pat. No. 5,451,444 (Deliso et. al.) describes these type of activated carbon bodies; this reference hereinafter incorporated by reference.

In another embodiment, the honeycomb adsorber is made completely of activated carbon, i.e., a shaped activated carbon structure as formed by the binderless forming method found in U.S. patent application, Ser. No. 08/650,685. As disclosed therein the method comprises forming a raw material mixture comprising a thermosetting liquid or solid resin, a carbonizable or inorganic hydrophilic filler, a temporary organic binder, and lastly an effective amount of extrusion aids. The raw material mixture is thereafter extruded, dried and cured to form a shaped body. Furthermore, the shaped body is thereafter be carbonized and activated to form an activated carbon honeycomb body.

Preferably, the shaped activated carbon structure raw material mixture consists essentially of, in percent by weight, of about 2–50% cellulose and/or wood fibers, about 30–45% inorganic filler selected from the group consisting of cordierite powder, clay, talc, and combinations thereof, about 4–10% organic binder selected the group consisting of methylcellulose derivatives, and combinations thereof about 0–2% lubricant, the balance being phenolic resin. Experimentally, it has been determined that the following raw material composition is most preferred, 56.6%, phenolic resin, 22.6% cellulose fiber, 15.1% cordierite, 4.7% methocel, 0.9% sodium stearate, and 1.0% cobalt acetate.

The precise size and shape of the activated carbon of the honeycomb bodies, including the appropriate cell size, cell wall size and cell density, is determined on an empirical basis. The optimal size and shape, and cell features for each system is generally a function of the engine operating conditions and is chosen so as to result in the correct flow and adsorption characteristics. Furthermore, regardless of size and shape, the design of the honeycomb adsorber itself is such that it generates the correct amount of vapor and the proper air-to-fuel ratio for easily starting the vehicle.

This being said, the ratio of total adsorber volume-to-open frontal area is one feature of the honeycomb which is easily modified to obtain the proper generation of vapor. On the one hand, a high ratio will release vapor in a shorter amount of time as the engine draws a large amount of air through the adsorber honeycomb; however, this is accomplished at the expense of "vapor-only" engine run-time. On the other hand, a smaller ratio will release its vapor over a longer period of time, but will generate less vapor instantaneously. By correctly choosing this frontal area/volume relationship for the particular engine and application, the carbon honeycomb will create a more appropriate air-to-fuel ratio. Carbon honeycomb configurations with the following total adsorber volume-to-open frontal area ratios have been investigated and are contemplated to be suitable for the instant system: (1) 5.6 $in^2$ to 61 $in^3$; (2) 22.5 $in^2$ to 61 $in^3$; (3) 45.1 $in^2$ to 61 $in^3$.

As mentioned above, the cell geometry is a feature which is controlled on the activated carbon honeycomb bodies to vary the adsorption and desorption rates of the carbon honeycomb. Activated carbon honeycomb bodies having 150 cells per inch and 20 mil wall thickness, i.e., a configuration having has an open area of 59%, have been successfully used in experimental systems. By changing this configuration the air's exposure to wall surface area would change, e.g. a higher open area honeycomb structure may be preferred to more easily and rapidly discharge the vapor.

To illustrate the increased vapor generation capability of the activated carbon honeycomb and thus its suitability in the instant invention, when compared to packed carbon pellet beds, the following experiment was done:

Two 1" inch diameter, 1½" long honeycomb substrates, Samples A and B, and one carbon pellet packed bed, Sample C, of the same dimension, were utilized in the experiment. Samples A and B, comprised of the aforementioned preferred composition, Sample A not containing the cobalt acetate component, were produced according the binderless forming method disclosed in U.S. patent application, Ser. No. 08/650,685. Sample C was a standard packed carbon pellet bed like that used in the cold-start fuel vapor engine systems previously mentioned in the Background.

Figure 2:
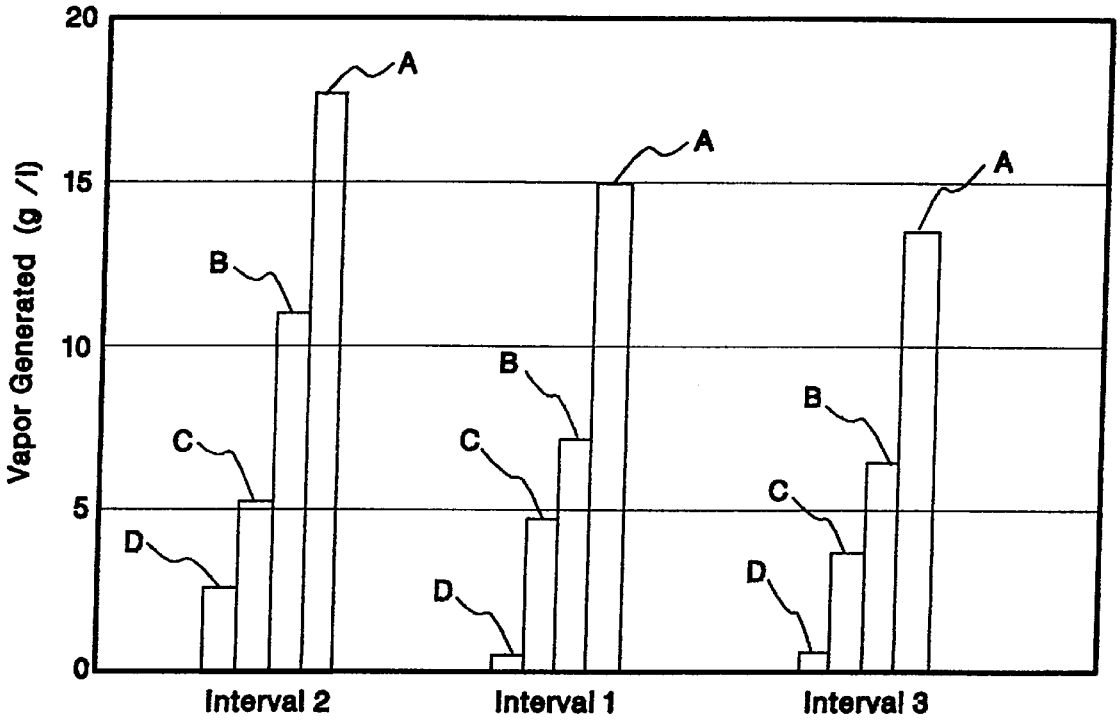
FIG. 2 is a bar-graph illustrating increased vapor generation capability of an activated carbon honeycomb adsorber of the instant invention.

Each of the three samples were saturated with gasoline vapor and thereafter subjected to an air flow of 0.5 lb/min per 1 liter of carbon (61 $in^3$) for three 20 second intervals; the samples were weighed both before and after each interval, the weight loss, equalling the amount of vapor generated. The weight loss, i.e., vapor generated, for each sample and interval was recorded and used to generate the FIG. 2. Referring now to that FIG., it can be seen that the Sample A activated carbon honeycomb body clearly demonstrated a greater capacity for releasing vapor when compared to the Sample C packed carbon pellet bed sample. Specifically, Sample A released 18 grams, 15 grams and 13 grams of vapor in three successive 20 second intervals, while the Sample C released 3 grams, less than 1 gram and less than 1 gram during the same intervals.

Ideally, the system should operate whereby the vapor is generated, i.e., desorbed from the activated carbon honeycomb adsorber, without any heating of the adsorber. However, under certain conditions, the system may require enhanced vaporization, preferably achieved by providing the system with a means for heating the activated carbon honeycomb adsorber. An extremely cold engine is one condition under which enhanced vaporization is likely to necessary.

In those system embodiments which do incorporate a heating means in order to enhance the desorption of the activated carbon honeycomb adsorber it is preferred that the heating means comprise a conducting means on the adsorber for conducting an electric current therethrough. Preferably, the adsorber will include an electrically conducting coating of a metal on two opposing surfaces of the adsorber for conducting an electric current therethrough; the metal coatings which may be effectively used, include copper, aluminum, silver, zinc, nickel, lead, tin and alloys thereof, with copper being the preferred coating. Electrically heatable activated carbon substrate having a conducting means such as those disclosed U.S. patent application, Ser. No. 08/249,897 would be suitable for use in the instant invention; this reference is hereinafter incorporated by reference.

Another possible configuration involves providing a means for heating the air prior to entering the activated carbon honeycomb via the air inlet, e.g. an electric coil, placed between the air inlet and the carbon honeycomb, heats the air entering the housing.

Regardless of the method of heating incorporated, it is desirable that the heating be extremely fast and therefore conveyed to the carbon instantaneously. Furthermore, it was experimentally determined that only enough heat is required to sustain an activated carbon body at a temperature of approximately 70° F. room temperature of the experiment. The actual heating would be controlled and initiated by the ECU; i.e., the engine temperature sensor would generate a signal below a certain temperature which would necessitate use of the heating device. The ECU would receive the signal and thereafter operate to cause an electric current to be delivered to the heating device, resulting in the heating of the adsorber and an enhancement of the release of the hydrocarbons.

The advantages of a system utilizing an activated carbon honeycomb adsorber in the housing over existing systems incorporating canister utilizing carbon pellets are as follows: First, air flow through the honeycomb is much improved, i.e., resistance to flow is greatly reduced, when compared to the systems utilizing carbon pellets in the canister, thereby allowing for a quicker removal of the vapors. Secondly, utilizing activated carbon honeycomb adsorbers increases the uniformity of the adsorption/desorption of the fuel from the adsorbent in the housing under a variety of ambient conditions. Third, utilizing a flow-through honeycomb structure, with its open frontal area and channel structure, as opposed to a canister containing activated carbon pellets, better allows liquid fuel to disperse more rapidly over the surface using a simple spray method, such as a simple fuel injector system. Lastly, in those applications which may require heating, the activated carbon honeycomb bodies have a far greater ability to be uniformly heated electrically to thereby create vapors at various ambient conditions.

Figure 3:
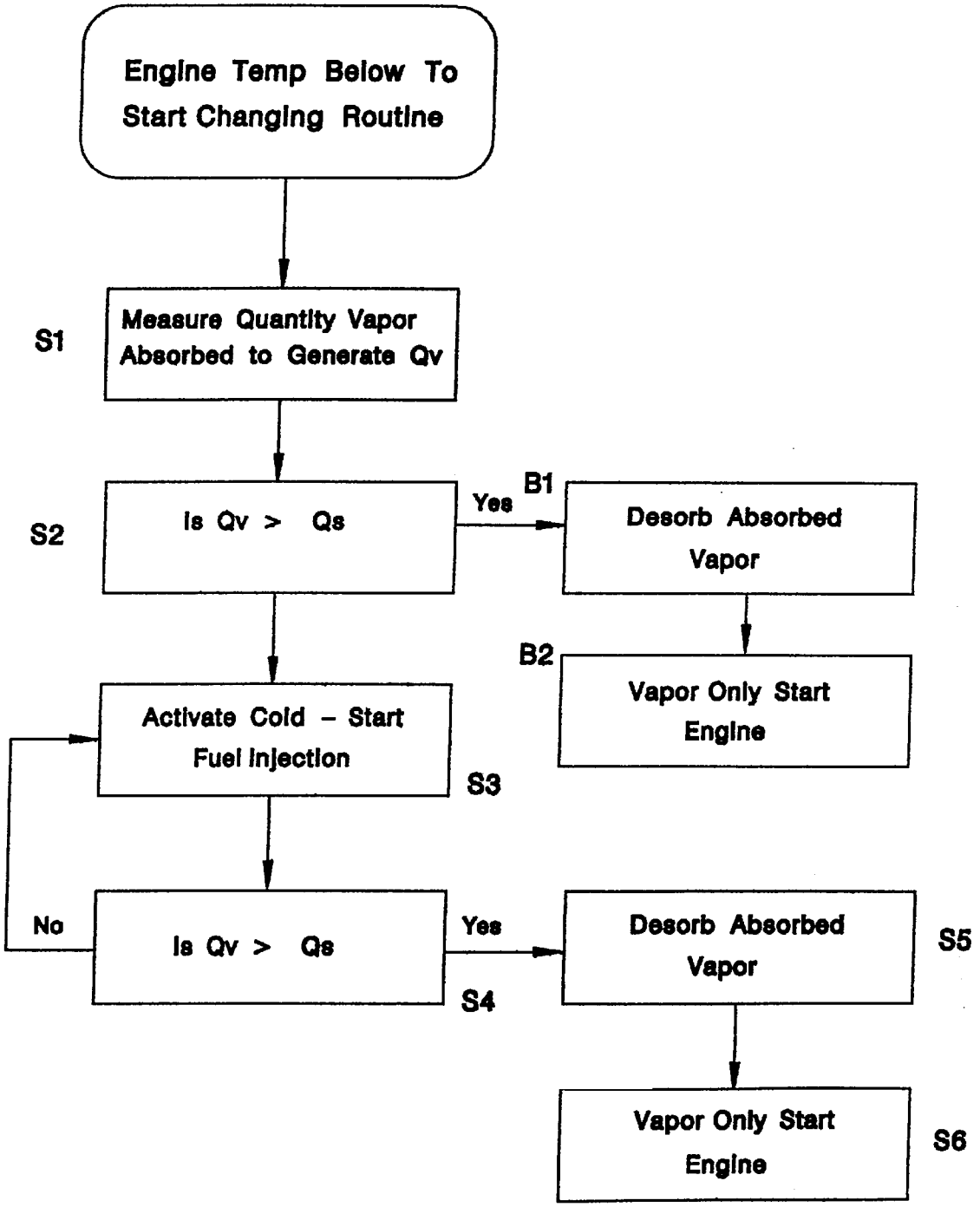
FIG. 3 is a flow chart illustrating the charging routine executed by the inventive system.

Referring now to FIG. 3, illustrated therein is a flow diagram of the charging routine utilizing the charging system as mentioned above. Prior to starting the engine 10 under cold-start conditions (i.e., an engine temperature below fee cold start temperature $T_c$), the first step S1 involves measuring, utilizing, for example a vapor sensor, the quantity of fuel vapor which has been adsorbed by the adsorber. An output signal ($Q_v$) representative of this adsorbed amount is generated and sent to the ECU; e.g., an electrical signal indicative of the amount of adsorbed fuel is supplied to the ECU. In other words, this charging routine occurs whenever the engine 10 has fallen below that temperature which would necessitate "vapor-only" starting. If there is sufficient vapor ($Q_v>Q_s$) to "vapor-only" start the engine the next step $B_1$ involves purging the vapor in the manner as described above and thereafter starting the engine $B_2$.

On the other hand, whenever the adsorbed fuel output signal is less than the amount necessary for "vapor-only" starting the engine ($Q_v<Q_s$), the next step S3 involves the ECU activating the fuel injector to deliver an amount of liquid fuel onto the surface of the adsorber. This delivery of liquid fuel, subsequently adsorbed by the adsorber, continues until the adsorber contains the amount of adsorbed fuel sufficient to "vapor-only" start the engine; i.e. step S4 is a repeat of step S2 involving measuring whether the adsorber contains sufficient fuel vapor. Once the adsorber has trapped sufficient fuel vapor necessary to "vapor-only" start the engine, the fuel is desorbed and the engine is started. As above, this desorption of the fuel vapor, step S5, involves introducing through the air inlet and into the adsorber a quantity of air which thereby forms an air/vapor-only fuel mixture. Simultaneously, the ECU functions to open the purge valve and this mixture is thereafter introduced into the intake manifold whereupon the engine may be "vapor-only" started; step S6.

This charging routine occurs at any time during engine stoppage, at its initial crank or during engine operation, as required for emission reduction. If the charging takes place when the engine stops, the spray device (fuel injector) injects the fuel onto the surface of the honeycomb structure at any time after the engine is turned off. The honeycomb structure adsorbs the fuel and holds it until the next start. Furthermore, the honeycomb structure is sized whereby it possesses adequate capacity to adsorb any fuel vapor generated by the tank during the stopped period, for example vapors generated during any refueling.

If the charging routine occurs at engine start, the spray device injects fuel onto the honeycomb structure immediately at first crank. The system is designed in a fashion whereby the honeycomb structure is able to adsorb and thereafter discharge the vapors quickly enough to provide adequate vapors to quickly start the engine.

The overall advantages of this system include the following: (1) the use of this system allows for a design optimization of the operating fuel injectors which in turn provides an improvement in fuel economy; (2) starting the engine on fuel vapor rather than liquid fuel, results in a reduction of the wall-wetting phenomenon and, therefore, a reduction in the amount of unburnt hydrocarbons; i.e., a reduction in the "cold start" emissions by limiting or eliminating the presence of liquid fuel; and (3) the air fuel mixture supplied to the engine during the cold start condition is nearly stoichiometric, or slightly lean, thereby increasing the fuel combustion efficiency and, in turn reducing the generation of noxious components; and, (4) as a direct result of the increase in the efficiency of burning, catalytic converter light off time is reduced.

"Adsorber" and "adsorption" as used herein are intended to encompass both adsorption and absorption as these terms are generally known to persons skilled in the art and as defined in *Webster's Ninth New Collegiate Dictionary* (1985); it is contemplated that both processes of adsorption and absorption occur in the activated carbon honeycomb adsorber of the invention.

The following non-limiting examples are presented to more fully illustrate the invention, however, the present invention is not restricted to these examples. Furthermore, these examples have been provided to demonstrate the feasibility of certain aspects the above-described invention.

EXAMPLE

Table I below reports the run times of various experimental test run examples conducted on a 4.6 liter, 2 valve internal combustion gasoline engine. An activated carbon honeycomb structure located in a housing having an air inlet and associated restricting orifice as described above was connected via a pipe to the engine's intake portion. The room temperature (approximately 70° F.) engine was "cold-started" utilizing only fuel vapor generated from the adsorber, as well as air drawn from the air inlet. The orifice sizes utilized were as follows: Examples 1–3—0.09" orifice, Examples 4–6—0.140" orifice and Examples 7–9—an air restricting device having two 0.23" orifices.

Figure 4:
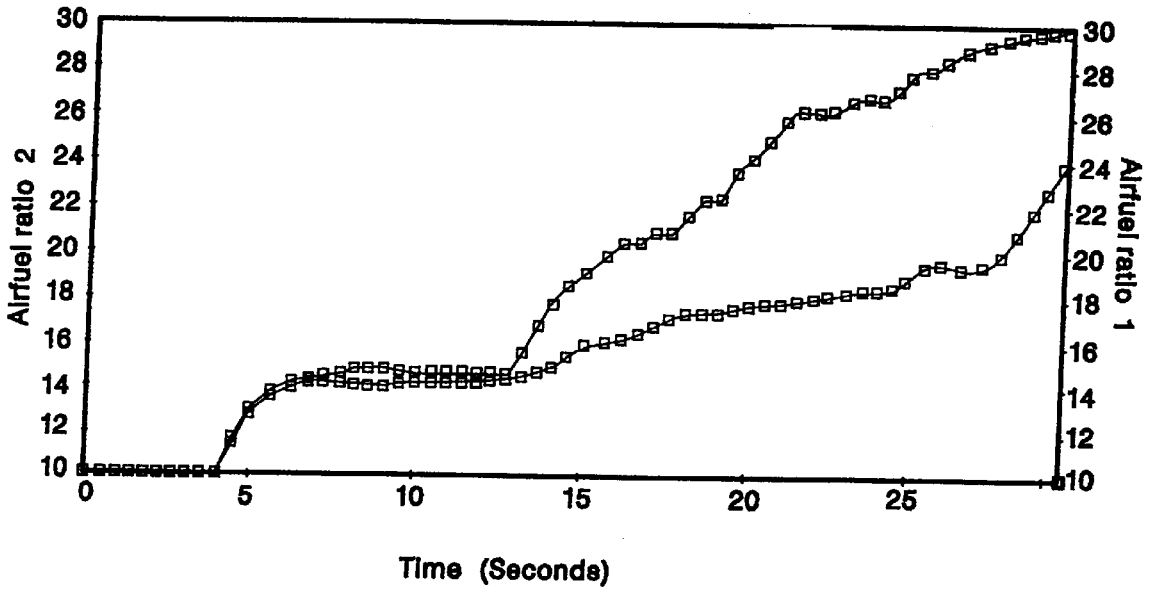
FIGS. 4 and 5 are graphs illustrating the air-to-fuel ratios of two representative experimental test-run examples.
Figure 5:
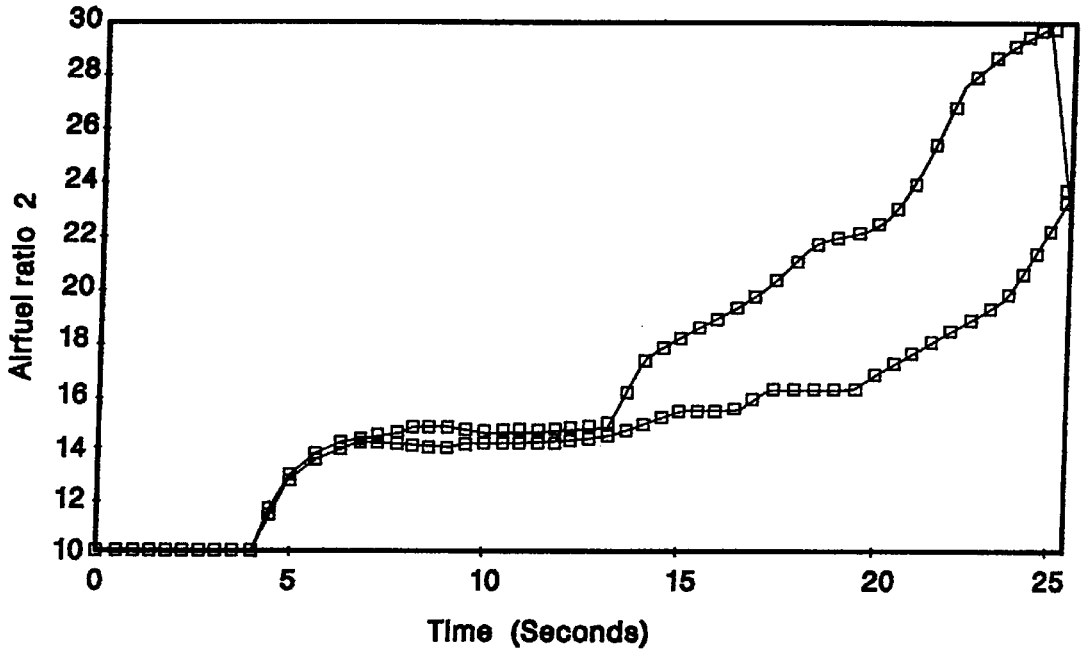

Specifically, the round honeycomb activated carbon adsorber, exhibiting a total volume of 1 liter, a 3.0" diameter and a 9.0" length , 150 cells per inch and 19.0 mil wall thickness, was comprised of the aforementioned preferred composition. For each experimental test run example the activated carbon adsorber was saturated with fuel vapor by immersing the honeycomb in gasoline and air drying it to ensure that the honeycomb contained no water. The vapor was thereafter introduced through the idle air system of the intake chamber using the natural aspiration of the engine, and the engine subsequently started. An examination of TABLE I reveals run-times for the experimental examples ranging from 24 to 43 seconds. It should also be noted for each of the nine experimental test-runs, that within 5 seconds of engine operation, the engine was running at, or below, the stoichiometric ratio of 14:1, as measured by an oxygen sensor positioned in the pipe just downstream of the adsorber. For example, FIGS. 4 and 5, test run experimental examples 5 and 6, reveal a rich air-to-fuel ratio of 10 for approximately the first 4 seconds of operation, an approximately stoichiometric ratio for about the next 9 seconds and a lean ratio for the duration of the engine operation.

TABLE I

| Example | 1 | 2 | 3 | 4 | 5 | 6 | 7 | 8 | 9 |
|---|---|---|---|---|---|---|---|---|---|
| Run time (sec.) | 32.5 | 43 | 32.5 | 30 | 25 | 29 | 24 | 28 | 19 |

Although the invention has been described with respect to the above illustrated description and examples, it may be subjected to various modifications and changes without departing from the scope of the invention.

We claim:

1. A recharging method for a vehicle having a cold-start fuel vapor emission control system coupled between an intake manifold and a fuel tank of an internal combustion engine and having a adsorber for adsorbing fuel vapor, the method comprising;

measuring the quantity of fuel vapor which has been adsorbed by the adsorber and providing an output signal representative whenever the engine temperature has fallen below a predetermined temperature;

activating a fuel injector to deliver an amount of liquid fuel onto the surface of the adsorber whenever the adsorbed fuel output signal is less than a predetermined amount necessary for vapor-only starting the engine, whereby the liquid is adsorbed by the adsorber, the amount of liquid fuel delivered being an amount sufficient to result in the adsorber having an amount of trapped fuel vapor necessary to vapor-only start the engine;

desorbing the trapped fuel vapor by introducing into the adsorber a quantity of air thereby forming a air/vapor-only fuel mixture and thereafter introducing the mixture to the intake manifold.

2. The method of claim 1 involving the additional step of maintaining a vacuum condition within the system while desorbing.

3. The method of claim 2 involving the additional step of heating the adsorber prior to desorbing.

4. A cold-start fuel vapor emission control system for an internal combustion engine having an intake manifold and a fuel tank, comprising:

a housing having a vapor inlet and an air inlet, the housing for containing an honeycomb adsorber for adsorbing fuel vapor;

a vapor passage for fluidly connecting the housing and the fuel tank;

a charging system which measures the quantity of adsorbed fuel vapor and which, if necessary, increases the amount of adsorbed fuel vapor to a level sufficient to vapor-only start the engine;

a purging passage connecting the housing to an intake manifold for introducing a mixture comprised of the fuel vapor and air to the intake manifold.

5. The system of claim 4 wherein the charging system comprises the following components:

a sensor for measuring the quantity of fuel vapor adsorbed and for providing a output signal representative;

a fuel injector for delivering liquid fuel to the surface of the honeycomb adsorber whenever the adsorbed fuel output signal is less than the predetermined amount necessary to vapor-only start the engine.

6. The system of claim 4 wherein the honeycomb adsorber is a monolithic, binderless honeycomb structure having a continuous activated carbon phase.

7. The system of claim 4 wherein the honeycomb adsorber comprises an inorganic monolithic substrate with pores extending into the substrates surface and a substantially continuous adherent coating comprising a layer of activated carbon extending over the substrate's surface and which penetrates into the pores.

8. The system of claim 7 wherein the substrate comprises cordierite.

9. The system of claim 4 wherein the honeycomb adsorber comprises a shaped activated carbon structure.

10. The system of claim 9 wherein the shaped activated carbon structure is made by extruding, drying and curing a raw material mixture about 2–50% cellulose and/or wood fibers, about 30–45% inorganic filler selected from the group consisting of cordierite powder, clay, talc, and combinations thereof, about 4–10% organic binder selected the group consisting of methylcellulose derivatives, and combinations thereof, about 0–2% lubricant, the balance being phenolic resin.

11. The system of claim 10 wherein the raw material mixture consists essentially of, in percent by weight, of 56.6%, phenolic resin, 22.6% cellulose fiber, 4.7% methocel, 0.9% sodium stearate, 15.1% cordierite and 1.0% cobalt acetate.

12. The system of claim 4 wherein the activated carbon honeycomb adsorber includes a means for the heating the adsorber.

13. The system of claim 12 wherein the means for heating the activated carbon honeycomb adsorber includes a conducting means on the adsorber for conducting an electric current therethrough.

14. The system of claim 13 wherein the activated carbon honeycomb adsorber includes an electrically conducting coating of a metal on two opposing surfaces of the conducting means for conducting an electric current therethrough.

15. The system of claim 14 wherein the metal coating is selected from the group consisting of copper, aluminum, silver, zinc, nickel, lead, tin and alloys thereof.

16. The system of claim 15 wherein the metal coating is copper.

17. The system of claim 4 wherein the honeycomb adsorber exhibits a open frontal surface area-to-volume of flow appropriate for delivering the proper fuel to air ratio.

18. The system of claim 17 wherein the honeycomb adsorber exhibits open frontal surface area-to-volume of flow ratio ranging between about 0.05 to 0.75 $in^2in^3$.

19. The system of claim 13 wherein the honeycomb adsorber exhibits open frontal surface area-to-volume of flow ratio less than about than 0.4 $in^2/in^3$.

20. The system of claim 13 wherein the honeycomb adsorber exhibits open frontal surface area-to-volume of flow ratio less than about than 0.1 $in^2/in^3$.

21. The system of claim 4 wherein the honeycomb adsorber exhibits a cell geometry whereby the resultant open area of the adsorber ranges between 25–75%.

22. The system of claim 4 wherein the honeycomb adsorber exhibits a cell geometry whereby the resultant open area of the adsorber ranges between 50–75%.

23. The system of claim 4 wherein the air inlet includes an air restricting inlet orifice.

* * * * *